US005603146A

United States Patent [19]

Heuermann et al.

[11] Patent Number: 5,603,146

[45] Date of Patent: Feb. 18, 1997

[54] ARRANGEMENT AND PROCESS FOR THE PRODUCTION OF SHORT WARPS

[75] Inventors: Josef Heuermann, Billerbeck; Herbert Wisniewski, Coesfeld-Lette; Josef Lenzen, Dulmen, all of Germany

[73] Assignee: Karl Mayer Textilmaschinenfabrik GmbH, Germany

[21] Appl. No.: 576,290

[22] Filed: Dec. 21, 1995

[30] Foreign Application Priority Data

Dec. 23, 1994 [DE] Germany ..... 44 46 279.4

[51] Int. Cl.[6] ..... D02H 9/02

[52] U.S. Cl. ..... 28/191

[58] Field of Search ..... 28/191, 198, 185, 28/195; 242/47.04, 47.01

[56] References Cited

U.S. PATENT DOCUMENTS

| | | | |
|---|---|---|---|
| 4,074,404 | 2/1978 | Schenk | 28/185 |
| 4,683,625 | 8/1987 | Baltzer | 28/191 |
| 4,765,041 | 8/1988 | Baltzer | 28/198 |
| 4,831,695 | 5/1989 | Baltzer | 28/198 X |
| 5,107,574 | 4/1992 | Beerli et al. | 28/191 |
| 5,410,786 | 5/1995 | Bogucki-Land | 28/191 |

FOREIGN PATENT DOCUMENTS

| | | |
|---|---|---|
| 1227398 | 10/1966 | Germany . |
| 2207370 | 8/1973 | Germany . |

*Primary Examiner*—Andy Falik
*Attorney, Agent, or Firm*—Omri M. Behr, Esq.

[57] ABSTRACT

In a process for the production of short warps, especially pattern weaves, an individual thread (1) of different or the same color is wound up on a wind surface (9,11) sequentially with turns lying next to each other in an individual layer. This layer corresponds to the warp length. A thread guide (4) is movable around the circumferential contour of a wind-up arrangement (2) in the wind plane. A forwarding arrangement further moves the side-by-side wound thread warp at each circuit of the thread guide (4) by an amount equivalent to the thread thickness. The first individual threads (1) are wound on a support surface (11) displaceable orthogonal to the wind plane (10). Each further individual thread (1) is wound onto the previously wound thread warp (18), having been displaced rearwardly by an amount at least equivalent to one thread thickness. After completion of the short warp, the thread warp (18) is obtained as an endless warp band and may be opened up in a direction transverse to the side-by-side lying threads (1).

16 Claims, 5 Drawing Sheets

ARRANGEMENT AND PROCESS FOR THE PRODUCTION OF SHORT WARPS

BACKGROUND OF THE INVENTION

1. Field of the Invention

The invention is directed to an arrangement and a process for the production of short warps, in particular for weave patterning in the field of color weaving, performed by relatively moving a thread guide device around a winding arrangement for winding thread and moving it orthogonally to the wind plane to make an endless thread warp band whose threads are then transversely cut.

2. Description of Related Art

For such a pattern and with short warp machines, threads of different or the same color are sequentially wound and laid next to each other in individual layers, wherein a thread laying means is moveable around the circumference of the wind-up arrangement. The thread warp obtained as an endless thread warp may be transversely cut apart after completion of the short warp.

Pattern and short warp warping machines of this type are well known (DE AS 12 27 398 and DE 22 07 370 B2). By means thereof, short warps may be wound with only one spool per color. One is thus able to produce thread warps over predetermined breadths of the entire warp having different thread colors to enable the formation of a woven pattern. One thus proceeds in the following manner: the wind surface which is attached to a carrier is displaceable perpendicularly to the wind plane of the thread laying device on the winding arrangement. The thread laying device is movable around the circumference of the winding arrangement in a direction orthogonal to the direction of motion of the winding surface, while the carrier is stationary with respect to the winding arrangement. The wind-up arrangement may comprise a drum having circumferential segments which are displaceable in the radial direction. These may comprise at least two turning rollers oriented separated from each other, which separation relative to each other, may also be displaced. The forwarding elements thus comprise forwarding bands running around a circumferential surface of the rollers, which suitably are provided to the drum in the wind surface, which run in the direction of the axis of the wind-up arrangement.

In the known procedures for the formation of short warps, the individual thread to be warped is laid off onto a forwarding element in an uncontrolled manner and is carried forward in dependence upon the set thread density. In a larger number of circuits, for example at about 6 to 8 circuits, a high thread density per centimeter, and with certain material qualities of threads, the threads during this lay-off are frequently intermingled. Thus during the dewarping stage, cross-linking threads can occur which can lead to a total destruction of the warp.

An object of the present invention therefore is to provide an arrangement as well as a process for the production of short warps in which the danger of cross-link thread formation during dewarping is substantially reduced and a longer maximum warp length may be produced.

SUMMARY OF THE INVENTION

In accordance with the illustrative embodiments demonstrating features and advantages of the present invention, a process can form short warps for patterns, including weave patterns, in which individual threads of different or similar color are wound sequentially, lying next to each other in individual layers corresponding to the desired warp length, on a wind surface of a winding arrangement. The winding arrangement includes: (a) a forwarding arrangement having a protruding support surface, and (b) an end face having a thread guide device. The process includes the step of relatively moving the thread guide device around the circumference of the winding arrangement in a wind plane. Another step is winding a first individual thread on the support surface, which is spaced from the wind surface, with individual thread orthogonally displaceable with respect to the wind plane. The process also includes the step of advancing at each circuit of the thread guide device, using the forwarding arrangement, side-by-side, warp thread windings by a distance corresponding to thread thickness. During warping the support surface is moved relative to the direction of the end face. Another step is completing the short warp with the thread warp produced as an endless thread warp band. The process also includes the step of cutting the endless thread warp in a direction transverse to threads lying next to each other after completion of the short warp.

A related arrangement according to another aspect of the present invention can produce short warps of threads of a different or same color for patterns, including weave patterns. The arrangement includes a winding arrangement having a winding surface and an end face. Also included is a thread laying means rotatably mounted at the end face of the winding arrangement for orbiting the winding arrangement and winding individual threads sequentially and next to each other in individual layers corresponding to the desired warp length. The arrangement also includes a forwarding arrangement mounted on the wind surface for receiving thread from the thread laying means and for transporting wound-up thread warp perpendicular to the wind plane by a distance corresponding to a predetermined wind advance. The forwarding arrangement has orthogonal to the wind plane, along a longitudinal portion of a length of the wind surface, a support surface protruding from the wind surface. The support surface tapers down in a direction toward the end face. Thus a thread warp produced as an endless thread warp band may be cut apart in a direction transverse to threads lying next to each other, in order to form the short warp.

By employing such a process or arrangement, advantageously, a wind surface extends, at least with respect to a portion of the length thereof, orthogonally to the wind plane. A preferred support surface projects from the wind surface for the winding up of the thread warp. In this manner, it is possible to wind the warped individual threads which run sequentially after each other and in a individual layer next to each other on this support surface. Accordingly, a controlled and defined lay-off of the individual threads can occur.

Preferably, all subsequent thread warps are wound upon the first monolayered thread warp that was wound onto the support surface. Thus each new thread is warped through a retraction of at least one thread thickness on the wind surface relative to the wind plane.

The preferred support surface rises in the direction away from the plane where thread is newly wound. This support surface rises from the wind surface of a forwarding arrangement. This wind surface stretches from the support surface the wind plane. During warping, the support surface is preferably moved towards the end face of the wind-up arrangement, until a desired warp length is obtained. To warp the next thread, the support surface may be retracted at least to its starting position so that for each thread warp the forwarding arrangement is moved back and forth like a reversing gear.

Arrangements according to the principles of the present invention achieve warps with 20 to 30 thread circuits produced per individual thread, so that short warps may be made having a warp length up to 200 meters at a quality level heretofore unobtainable.

The warps produced in this manner can be beamed without problems and exhibit an extraordinary quality. The debeaming procedure is no longer disturbed by the substantially reduced problem of cross-linking threads.

A further advantage is found therein that the debeaming may be carried out at substantially higher speeds.

It is advantageous to employ a conical support surface which is tapered in the direction of the wind plane.

It is provided that at the beginning, the first thread of the warp is warped from a base position. At each revolution of the thread laying means, the forwarding arrangement transports the wind surface carrying the wound-up thread warp by one thread thickness orthogonal to the wind plane. When the first thread is completely warped corresponding to the desired warp length, the forwarding arrangement is returned to a location at least one thread thickness beyond to the base position. Subsequently, the second thread is warped onto the first, suitably conical, thread warp.

The controlled lay off of individual threads makes it possible to provide a wind surface comprising a warp of between 20 to 30 circumferential lengths.

The forwarding arrangement preferably comprises a plurality of parallel, localized, synchronously movable forwarding elements. These forwarding elements may have a wind element, conically diverging in a direction transverse to the wind plane. The preferred forwarding elements may comprise forwarding bands running parallel to the axis of the winding arrangement, on whose outer side a conically flared wind element is attached which tapers in the direction of the wind plane.

Between the neighboring forwarding elements may be conically arranged support plates, corresponding to the cone of the cone elements. These conical elements are movable synchronously with the winding element. The conical support plates may extend either in a straight line or an arc between the wind elements.

A thread guiding arrangement in the form of one or several guide plates can be provided over the wind surface in such a way that the thread laying means surrenders the threads exactly in a predetermined wind plane as defined by the leading edge on the wind surface. In conjunction with a corresponding control means for the forwarding elements, the thread guide arrangement advantageously makes it possible, to provide an exactly defined surrender of the individual threads onto the wind surface.

The thread guide arrangement can run circumferentially about the circumference of the wind surface or may be divided up into a plurality of guide plates which are solely provided in the vicinity of the forwarding elements.

BRIEF DESCRIPTION OF THE DRAWINGS

The above brief description as well as other objects, features and advantages of the present invention will be more fully appreciated by reference to the detailed description of presently preferred but nonetheless illustrative embodiments in accordance with the accompanying drawings, wherein.

DETAILED DESCRIPTION OF THE PREFERRED EMBODIMENTS

Figure 1:
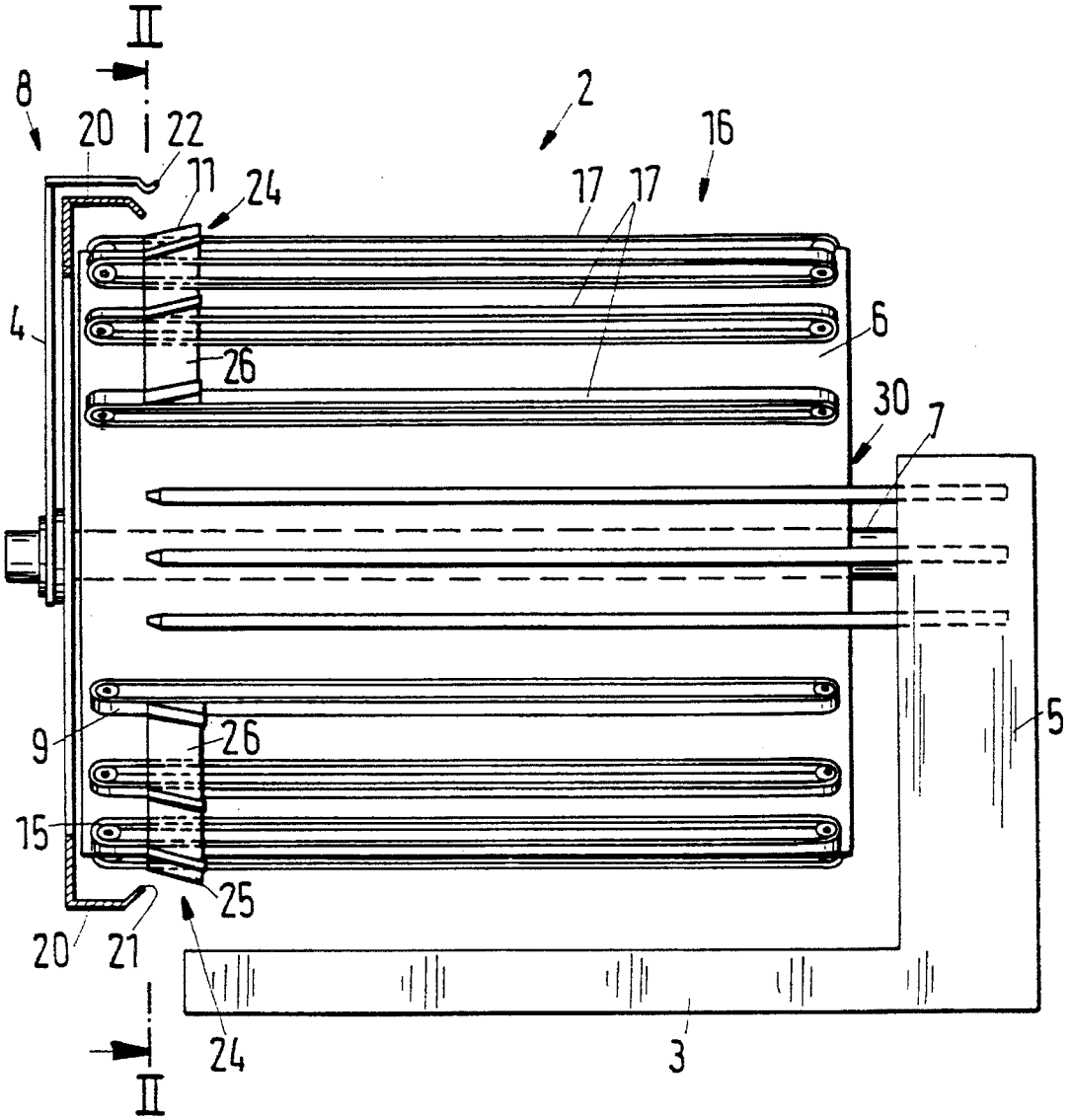
FIG. 1 is a side view of an arrangement in accordance with the principles of the present invention.

The wind-up arrangement (2) for the production of short warps, suitably for weave patterns in colored weaving, comprises a frame (3) in which a drum (6) of predetermined length is located on a drum axis (7), which is carried by the side wall (5) of frame (3). The drum (6) located upon drum axis (7) is rotatable and may be stopped by a suitable braking means (not shown).

A thread laying means (4) is located on the drum axis (7). The thread layer (4) carries a follower (22) with the aid of which, each individual thread (1) may be wound onto wind surface (9) formed on drum (6) by forwarding arrangement (16) of the winding arrangement (2). The thread layer (2) is provided to the end face (8) of drum (6) and rotates with follower (22) around the circumference of drum (6).

The individual thread (1) is laid off via follower (22) onto the forwarding arrangement (16) located on the circumference of drum (6) wherein the forwarding arrangement (16) transports the wound up thread warp in a direction perpendicular to the wind plane (10, FIGS. 3–7) defined by the leading edge of a thread guide arrangement (20) by an amount corresponding to the wind advance. This means that the wound up thread warp of an individual thread (1) is continually transported relative to thread layer (4), parallel to the drum axis (7).

The drive for the displacement motion of the forwarding arrangement (16) is exactly led off from the rotational movement of the thread layer (4), wherein the forwarding speed is so determined with respect to the thread thickness, that each of the winds of the individual thread at each circuit lies exactly next to each other on the winding surface (9, 11).

The forwarding arrangement (16) comprises forwarding bands (17) lying parallel to the drum axis (17), which run endlessly about two turning rollers (15) located on the circumference of drum (6). The forwarding bands (17) are moved forward by a predetermined forwarding path, which corresponds to the thread thickness at each thread circuit.

The thread layer (4) provided with follower (22) can wind up the individual thread from one spool. The progress of the forwarding arrangement is so set that each individual thread can be wound up sequentially in individual layers to lie next to each other on a conical support surface (11) provided on wind surface (9).

When an appropriate number of threads corresponding to a pattern is warped in this manner, the thread warp thus obtained as an endless thread band can be opened up in the transverse direction to obtain the desired pattern warp.

The drum (6) is suitably provided with seven forwarding bands (17) on its upper and lower halves. The drum (6) is flattened at its sides and on both sides has vertical segments in which partial rod arrangement (30), suitably with three partial rods, may be provided on one or both sides.

Figure 2:
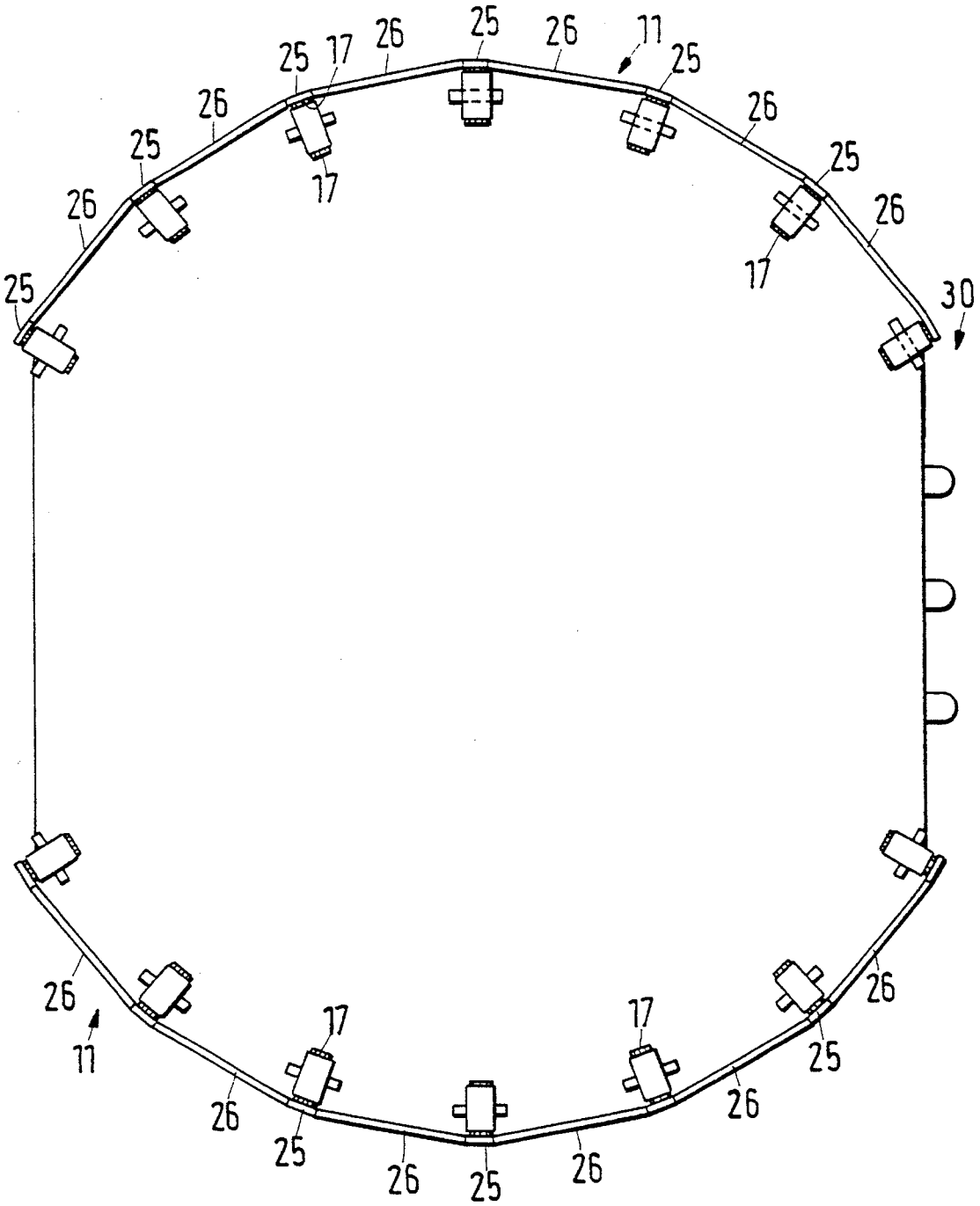
FIG. 2 is a view along line II—II of FIG. 1.
Figure 3:
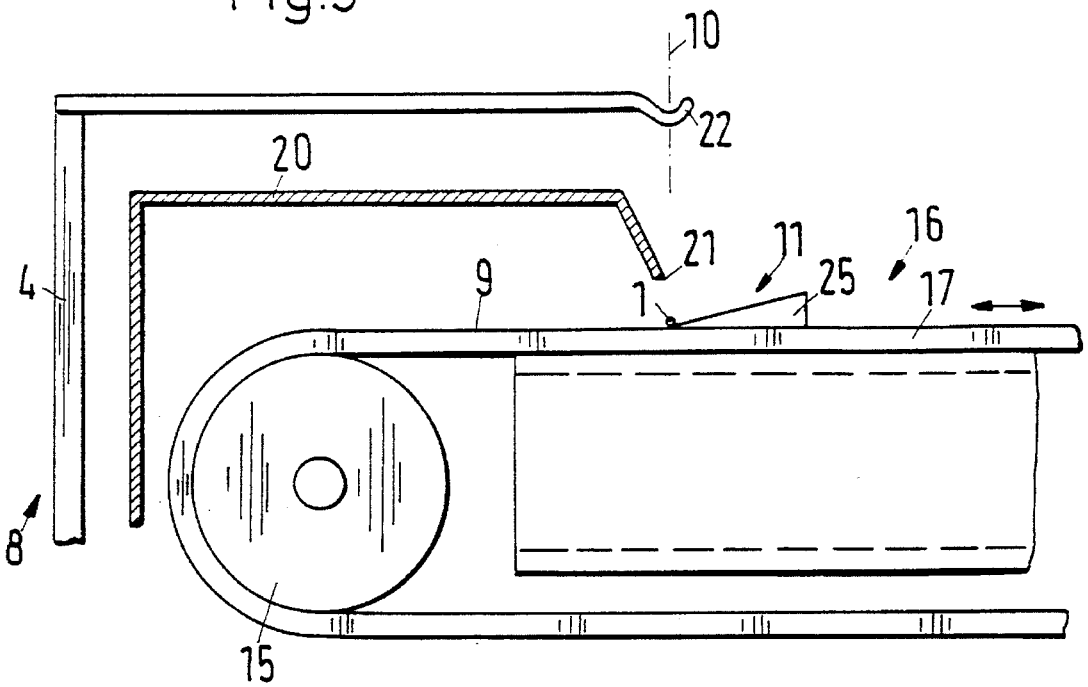
FIG. 3 shows the forwarding bands of FIG. 1 in the base position of the machine.

FIG. 2 shows a cross-section along line II—II in FIG. 1. The forwarding bands (17) of the forwarding arrangement (16) are equally distributed upon each of the halves of the drum circumference.

On each of the forwarding bands (17), a frustro-conical winding element (25) is rigidly affixed, which can be moved to and fro with the support bands (17) relative to the wind plane (10). Support plates (26) are provided between the winding elements (25) on the forwarding bands (17) which, corresponding to the cone angle of, for example 15°, of the winding element (25) are set an angle relative to the wind surface (9) and together with the wind element (25) form the conical support surface (11).

The support plates (26) are moved together and synchronously with the wind elements (25) and are affixed to these in a suitable manner. The breadth of the support plate (26) corresponds to the length of the conical flank of winding element (25). The support plates (26) can run in straight lines between the winding elements (25) or can be bent according to the effective bending radius of drum (6). Similarly, the conical surfaces of the wind elements may be curved in accordance with the radius of curvature of the drum in order to provide a winding cone (24) having a circular bow-shaped cross-section.

The support plates (26) may similarly run on the vertical side of drum (6) which however is not illustrated in FIG. 2.

Figure 4:
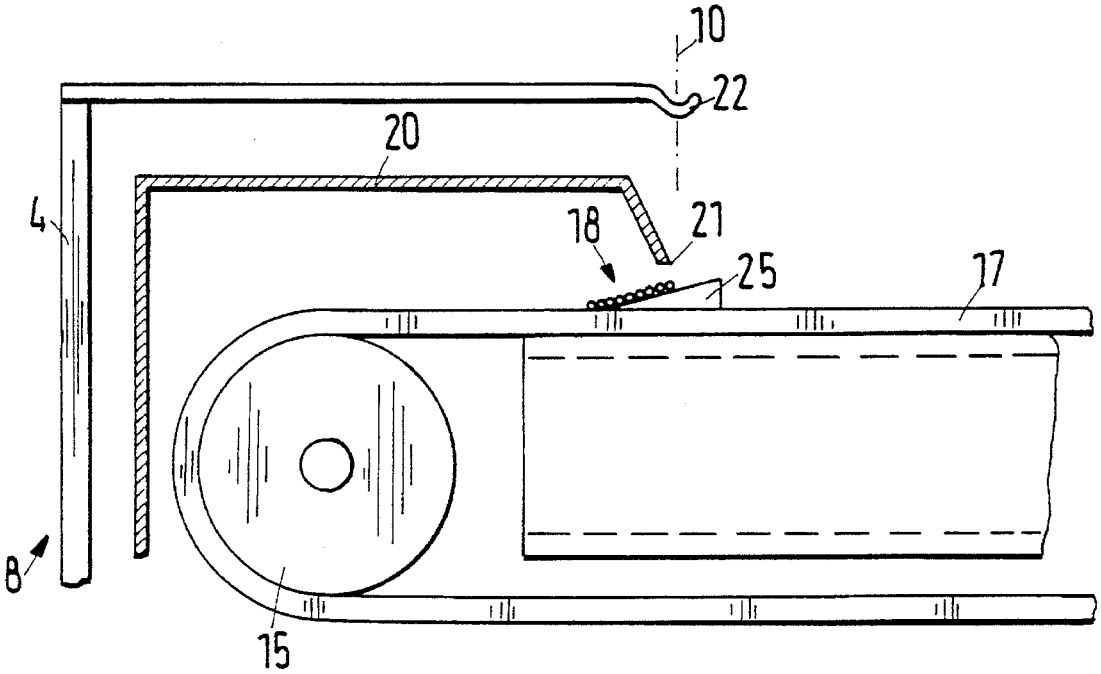
FIG. 4 shows the forwarding bands of FIG. 3 after several circuits of an individual thread.
Figure 5:
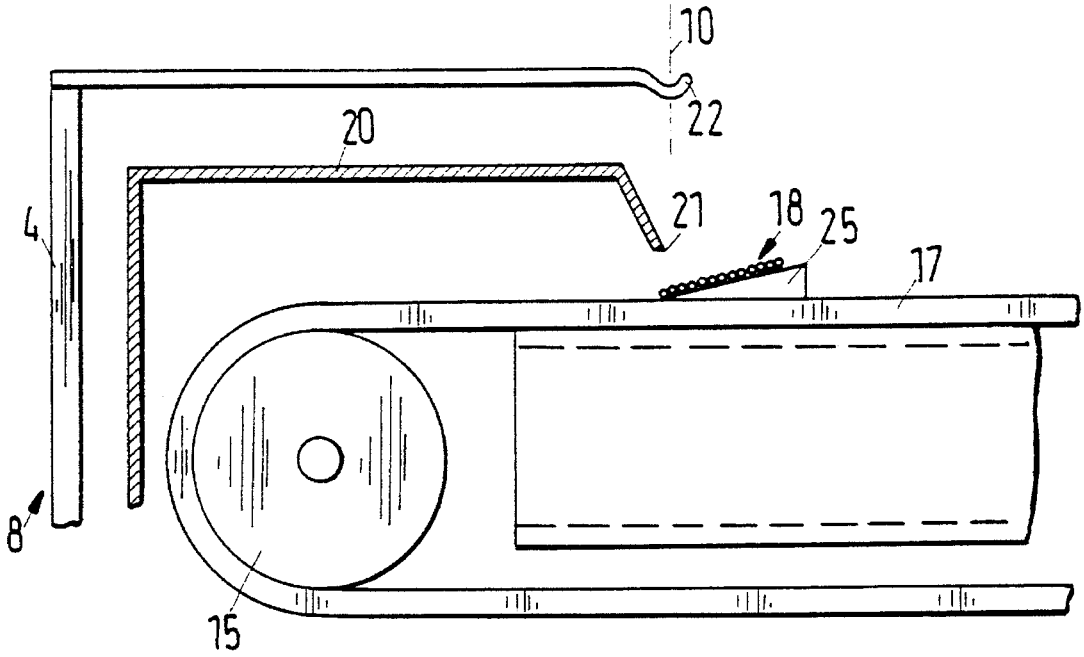
FIG. 5 shows the ground position for a second individual thread.
Figure 6:
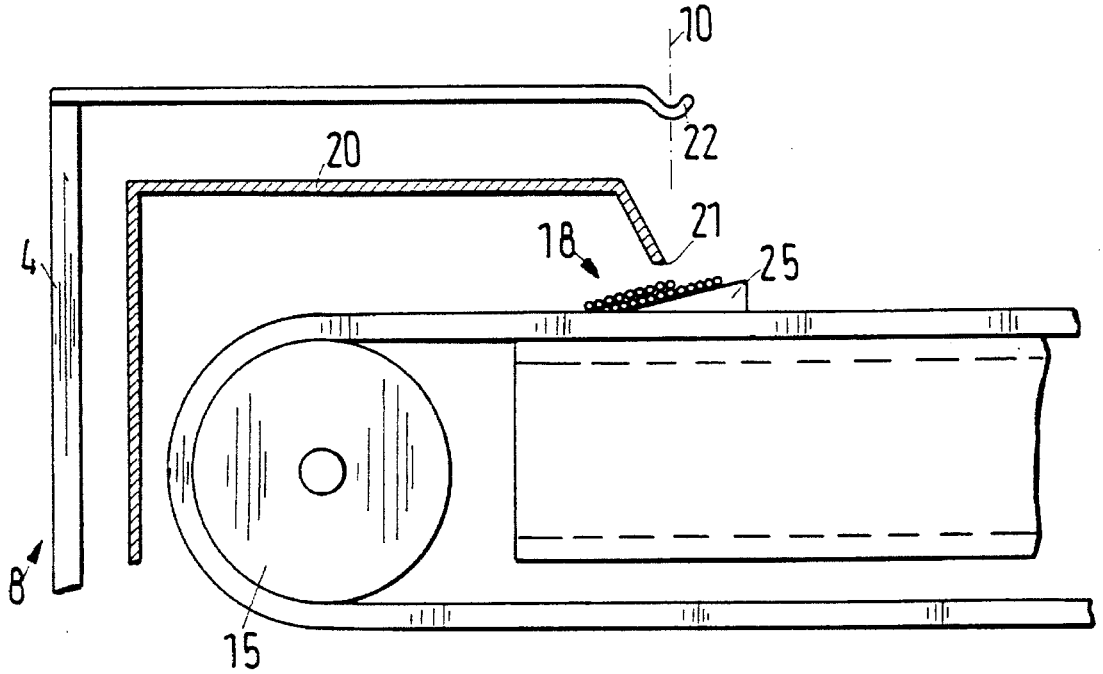
FIG. 6 shows an intermediate position during the wind-up of the second thread.

FIG. 4 shows the machine base position in warping the first individual thread. The winding element (25) are so positioned on the forwarding bands (17) that, relative to the leading edge (21) of the thread guide arrangement (20), the wind plane (10) is defined to hold a spacing of one thread breadth. Thus, the thread is laid-off onto the winding surface (9) at the first circuit and merely from the second circuit upon the conical support surface (11).

The number of circuits is determined by the desired warp length, wherein the individual threads (1), as shown in FIG. 4, are progressively wound onto the conical surface of the winding cone (24). The thread layer (4), with the assistance of follower (22), allows the thread to orbit in the wind plane (10), wherein the leading edge (21) of the thread leading arrangement permits an exact positioning of the individual thread before its release onto the winding cone (24).

The forwarding bands (17), moved at each circuit by the amount of the thread width in the direction of the end face (8) of drum (6), corresponding to the wind progress. When the warping of the first individual thread is completed, the forwarding bands (17) ride back until the base position of the first thread is bypassed by at least one thread thickness. Thus, the first circuit of the next individual thread is again wound onto the wind surface (9) and as of the second circuit on the already existing thread warp (18) of the previous individual thread (1). As will be seen from FIG. 6, the second thread warp is displaced by two thread thicknesses relative to the first thread warp in the direction of the end face (8) of the wind-up arrangement (2).

Figure 7:
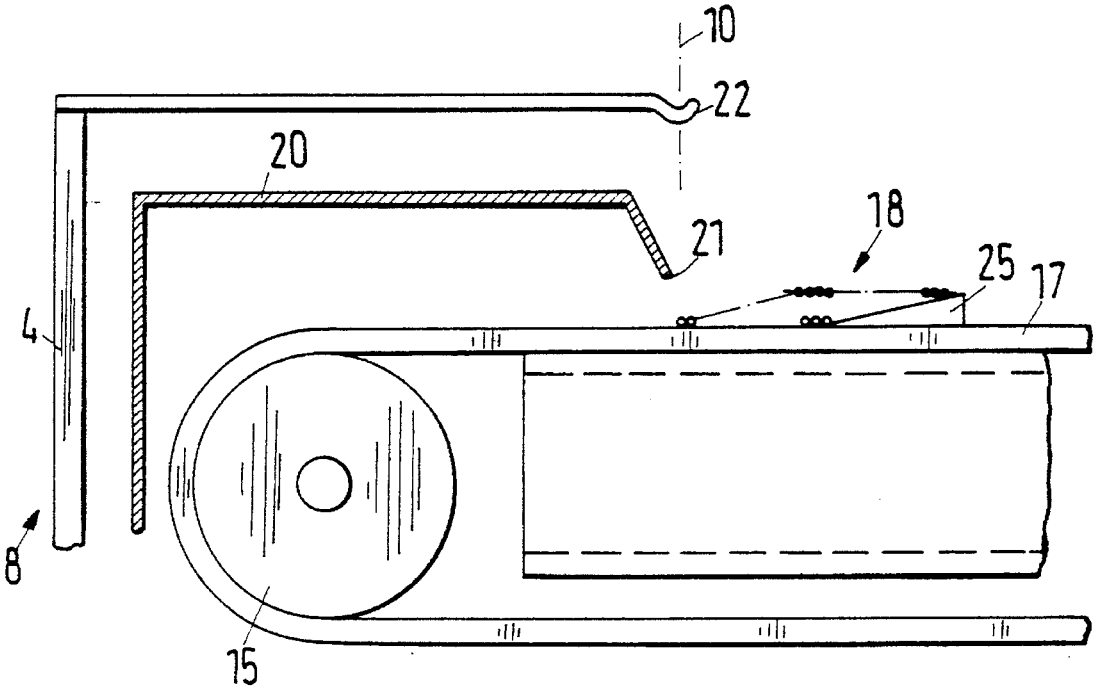
FIG. 7 shows the position of the forwarding band after winding up of a plurality of individual threads.

FIG. 7 shows the forwarding bands (17) with a plurality of conically wound-up thread warps (18).

Each thread warp is wound as an individual layer wherein the last several thread warps are wound up and then displaced with respect to one another by the amount of a thread thickness.

In contrast to the heretofore available short warping machines, it is possible to provide longer warp lengths wherein the overall length may be reduced. The exact lay-off of the individual threads onto the conical surface reduces the danger of cross-linked thread formation, so that at the same time, warps of a higher quality may be produced which can be wound off during a considerably accelerated debeaming procedure of drum (6).

An electronic control synchronizes the movement of thread guide (4) with the forwarding movement of the forwarding arrangement (16) during the warping of a individual thread (1). For this purpose the thread layer (4) is provided with a level drive for, for example, AC servo drive, with a rotation indicator. The forwarding bands (17) are driven by a following drive, for example, AC servo drive, which is provided with a tachometer, for example a resolver and a rotation indicator. With the assistance of the data provided to the control relating to the warping, for example thread thickness, desired warp length, warping speed, the control calculates the desired value for the lead drive and the following drive and supervises their retention by means of the named measurement arrangements.

Obviously many modifications and variations of the present invention are possible in light of the above teachings. It is therefore to be understood that within the scope of the appended claims, the invention may be practiced otherwise than as specifically described.

We claim:

1. Process for forming short warps for patterns, including weave patterns, in which individual threads of different or similar color are wound sequentially, lying next to each other in individual layers corresponding to a desired warp length, on a wind surface of a winding arrangement including (a) a forwarding arrangement having a protruding support surface, and (b) an end face having a thread guide device, comprising the steps of:

relatively moving the thread guide device around the circumference of the winding arrangement in a wind plane;

winding a first individual thread on the support surface, which is spaced from the wind surface, with initial and subsequent windings of individual threads orthogonally displaceable with respect to the wind plane;

advancing at each wind of the thread guide device, using the forwarding arrangement, side-by-side, warp thread windings by a distance corresponding to thread thickness, wherein during warping the support surface is moved relative to the direction of the end face;

completing the short warp with the thread warp produced as an endless thread warp band; and cutting the endless thread warp in a direction transverse to threads lying next to each other after completion of the short warp.

2. Process in accordance with claim 1, comprising the step of:

winding subsequent windings of individual threads onto thread warp windings previously wound onto the support surface, but retracted by at least one thread thickness in a direction away from the support surface.

3. Process in accordance with claim 2, wherein the support surface is approximately conical and tapers down in a direction toward the end face.

4. A process in accordance with claim 3, wherein the step of completing the short warp is performed by:

moving the thread warp of the first individual thread out of a base position relative to the direction of the wind plane, with individual thread being wound up progressively higher on the support surface into an individual layer corresponding to the desired warp length for the formation of a first thread warp;

after completion of the winding process for the first individual thread, relatively retracting the thread warp relative to the wind plane in a direction toward the base position and then past the base position by an amount of at least one thread thickness, to affect a following thread layer by (a) relatively displacing the thread warp by at least one thread thickness in the direction of the wind plane, and (b) winding onto a previously wound thread warp; and similarly winding each subsequent thread onto the thread warp already existing.

5. Process in accordance with claim 4, wherein the step of relatively moving the thread guide device is performed by:

laying individual thread from the thread guide, before delivery onto the wind surface, with the thread guide device in a position precisely defined with respect to the wind plane.

6. Process in accordance with claim 1, wherein the support surface is approximately conical and tapers down in a direction toward the end face.

7. A process in accordance with claim 1, wherein the step of completing the short warp is performed by:

moving the thread warp of the first individual thread out of a base position relative to the direction of the wind plane, with individual thread being wound up progressively higher on the support surface into an individual layer corresponding to the desired warp length for the formation of a first thread warp;

after completion of the winding process for the first individual thread, relatively retracting the thread warp relative to the wind plane in a direction toward the base position and then past the base position by an amount of at least one thread thickness, to affect a following thread layer by (a) relatively displacing the thread warp by at least one thread thickness in the direction of the wind plane, and (b) winding onto a previously wound thread warp; and similarly winding each subsequent thread onto the thread warp already existing.

8. Process in accordance with claim 1, wherein the step of relatively moving the thread guide device is performed by:

laying individual thread from the thread guide, before delivery onto the wind surface, with the thread guide device in a position precisely defined with respect to the wind plane.

9. Arrangement for the production of short warps of threads of a different or same color for patterns, including weave patterns, comprising:

a winding arrangement having a winding surface and an end face;

a thread laying means rotatably mounted at the end face of the winding arrangement for orbiting the winding arrangement and winding individual threads sequentially and next to each other in individual layers corresponding to the desired warp length; and a forwarding arrangement mounted on said wind surface for receiving thread from said thread laying means and for transporting wound-up thread warp perpendicular to the wind plane by a distance corresponding to a predetermined wind advance, said forwarding arrangement having orthogonal to the wind plane along a longitudinal portion of a length of the wind surface a support surface protruding from the wind surface, said support surface tapering down in a direction toward the end face, so that a thread warp produced as an endless thread warp band may be cut apart in a direction transverse to threads lying next to each other in order to form the short warp.

10. Arrangement in accordance with claim 9 comprising means for moving the support surface in a direction toward the end face during the warping process.

11. Arrangement in accordance with claim 10, wherein the forwarding arrangement comprises:

a parallel plurality of side-by-side, forwarding elements which are synchronously movable; and a plurality of substantially frustro-conical wind elements separately mounted at corresponding ones of said forwarding elements for providing said support surface.

12. Arrangement in accordance with claim 10, wherein the thread laying means comprises:

a thread guide arrangement having a leading edge and mounted over the wind surface (9,11) for laying off thread onto the wind surface exactly in the wind plane as defined by the leading edge of the thread guide arrangement.

13. Arrangement in accordance with claim 9, wherein the forwarding arrangement comprises:

a parallel plurality of side-by-side, forwarding elements which are synchronously movable; and a plurality of substantially frustro-conical wind element separately mounted at corresponding ones of said forwarding elements for providing said support surface.

14. Arrangement in accordance with claim 13 comprising:

a plurality of substantially frustro-conical support plates separately mounted between the forwarding elements and spanning the wind elements, and means for moving said support plates synchronously with the wind elements and together with the wind elements forming a winding cone on at least a circumferential contour portion of the winding arrangement.

15. Arrangement in accordance with claim 9, wherein the thread laying means comprises:

a thread guide arrangement having a leading edge and mounted over the wind surface (9,11) for laying off thread onto the wind surface exactly in the wind plane as defined by the leading edge of the thread guide arrangement.

16. Arrangement in accordance with claim 15 wherein the thread guide arrangement comprises:

a spaced plurality of guide plates mounted only in the vicinity of the forwarding elements.

* * * * *